US008261576B1

(12) United States Patent
Clements

(10) Patent No.: US 8,261,576 B1
(45) Date of Patent: Sep. 11, 2012

(54) EARRING WITH FORWARD PROTRUDING POST

(76) Inventor: Ann M. Clements, Bristol, PA (US)

( * ) Notice: Subject to any disclaimer, the term of this patent is extended or adjusted under 35 U.S.C. 154(b) by 615 days.

(21) Appl. No.: 12/267,563

(22) Filed: Nov. 8, 2008

(51) Int. Cl.
*A44C 7/00* (2006.01)

(52) U.S. Cl. ..... 63/12; 63/13; D11/43

(58) Field of Classification Search ..... 63/12, 13; D11/40, 42, 43, 44, 45, 77
See application file for complete search history.

(56) References Cited

U.S. PATENT DOCUMENTS

| | | | | | |
|---|---|---|---|---|---|
| 1,106,388 | A | * | 8/1914 | Juergens | 63/14.8 |
| 4,497,186 | A | * | 2/1985 | Mason | 63/13 |
| D294,684 | S | * | 3/1988 | Saraga | D11/42 |
| 5,080,518 | A | | 1/1992 | Mason | |
| 5,123,264 | A | * | 6/1992 | Simmons | 63/12 |
| 5,161,391 | A | * | 11/1992 | Lorberfeld | 63/13 |
| D344,910 | S | * | 3/1994 | Nelson | D11/79 |
| D347,801 | S | * | 6/1994 | Church | D11/40 |
| 5,515,584 | A | * | 5/1996 | Adell | 24/709.8 |
| D374,637 | S | | 10/1996 | Esser | |
| D418,079 | S | * | 12/1999 | Porcell | D11/40 |
| 6,925,838 | B1 | * | 8/2005 | Carmack | 63/12 |
| 2005/0247079 | A1 | * | 11/2005 | Padeh | 63/13 |
| 2007/0051132 | A1 | | 3/2007 | McCarty-O'Brien | |
| 2008/0053147 | A1 | * | 3/2008 | Freeman | 63/13 |

* cited by examiner

*Primary Examiner* — Victor Batson
*Assistant Examiner* — Emily Morgan
(74) *Attorney, Agent, or Firm* — LaMorte & Associates, P.C.

(57) ABSTRACT

An earring assembly that displays the post of the earring through the body of the earring. The earring has an ornamental body with a face surface and an opposite rear surface. An opening is formed through the ornamental body. A contoured post is provided. The first end of the contoured post is coupled to the ornamental body at a hinged connection. The contoured post has a first section that extends away from the hinged connection and behind the rear surface. The contoured post also has a second section that extends from the first section to its second end. The second section extends through the inner opening of the ornamental body and positions the second end of the contoured post in front of the face surface of the ornamental body.

16 Claims, 3 Drawing Sheets

EARRING WITH FORWARD PROTRUDING POST

BACKGROUND OF THE INVENTION

1. Field of the Invention

In general, the present invention relates to the structure of earrings. More particularly, the present invention relates to the shape and orientation of both an earring and the post that is used to anchor the earring to a person's ear.

2. Prior Art Description

Earrings have been in existence since before the beginning of recorded history. In this vast period of time, earrings have been created in countless varied forms.

In modern times, most earrings have the same general construction. The earring has an ornamental body that is intended to be viewed. The ornamental body is attached to a post that extends through a narrow piercing in a person's earlobe, thereby joining the ornamental body to the ear. The post of the earring is prevented from falling out of the piercing in the earlobe, either through the use of a complex post shape or the use of a removable stop that attaches to the post.

Earring posts with complex shapes are commonplace. Consider, as an example, U.S. Patent Application Publication No. 2007/0051132 to McCarty, entitled Self-Seating Earring Wire and U.S. Pat. No. D344,910, to Nelson, entitled Earring.

Short earring posts do not have the body length needed to prevent the post from falling out of a piercing. Accordingly, earrings having short posts typically use stops to lock the posts in place.

Many earring designs rely upon both the shape of the posts and the use of a stop to hold an earring in place. Such prior art earring designs are exemplified by U.S. Pat. No. D374,637 to Esser, entitled Earring, and U.S. Pat. No. 5,080,518 to Mason, entitled Decorative Earring With Animal Shapes.

In most earring designs, both the earring post and the earring stop are intended to be hidden from view. Furthermore, the post and stop are typically made to be plain so as not to detract from the aesthetics of the earring's ornamental body.

In the present invention, the opposite effect is used. The earring has a post and stop that are visible. Furthermore, the ornamental body of the earring is configured to emphasize the visibility of both the post and stop. This novel earring configuration is described and claimed below.

SUMMARY OF THE INVENTION

The present invention is an earring assembly that displays the post of the earring through the body of the earring. The earring has an ornamental body with a face surface and an opposite rear surface. The face surface of the ornamental body is viewed when the earring assembly is worn. An opening is formed through the ornamental body between the face surface and the rear surface.

A contoured post is provided that extends between a first end and a second end. The first end of the contoured post is coupled to the ornamental body at a hinged connection. The contoured post has a first section that extends away from the hinged connection and behind the rear surface. The contoured post also has a second section that extends from the first section to its second end. The second section extends through the inner opening of the ornamental body and positions the second end of the contoured post in front of the face surface of the ornamental body. In this manner, the second end of the contoured post extends in front of the ornamental body and is readily viewed.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention earring can be embodied in many ways, the present invention is particularly well suited for configuration as an earring having an ornamental loop. Accordingly, in order to set forth one of the best modes contemplated for the invention, the present invention is being illustrated and described as being configured as a loop earring. The selected embodiment, however, is merely exemplary and should not be considered a limitation when interpreting the scope of the appended claims.

Figure 1:
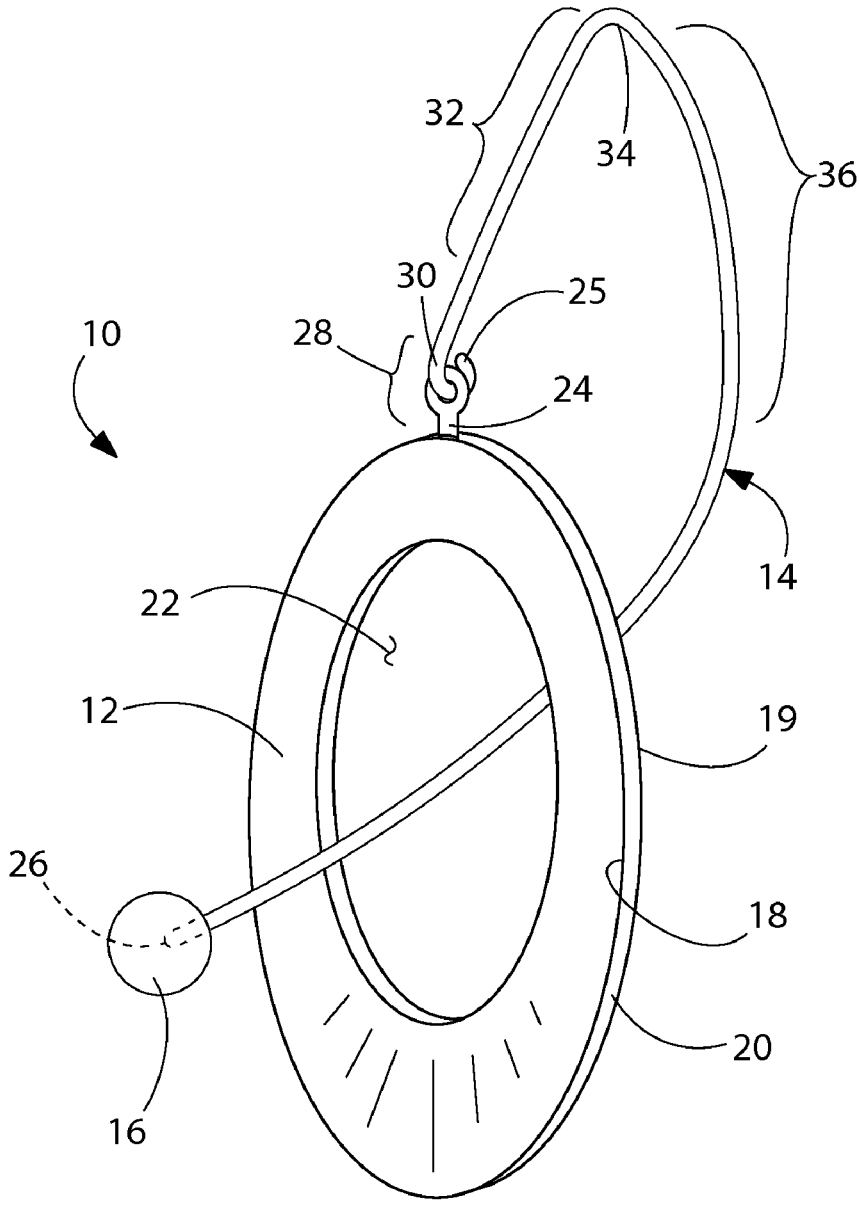
FIG. 1 is a perspective view of an exemplary embodiment of an earring assembly.

Referring to FIG. 1, there is shown an earring assembly 10. The earring assembly 10 includes an ornamental body 12, a contoured post 14 and a decorative stop 16. The ornamental body 12 being illustrated is that of a continuous loop. Accordingly, the ornamental body 12 is annular in shape. The ornamental body 12 has a face surface 18 and an opposite rear surface 19 defined between a common peripheral edge 20. When the earring assembly 10 is worn, it is the face surface 18 of the earring assembly 10 that is most visible.

An inner opening 22 is formed through the ornamental body 12. In the shown embodiment, the inner opening 22 is circular. It will be understood that loop earrings can be formed in many shapes other than is being illustrated. However, most all loop earring designs have a body with an inner opening and an exterior defined by a peripheral edge. The configuration of the ornamental body 12 between the inner opening 22 and the peripheral edge 20 has no bearing on the invention. Thus any known earring design with an inner opening can be used.

A mounting loop 24 is coupled to the ornamental body 12. The mounting loop 24 extends from the peripheral edge 20 of the ornamental body 12 at the top of the ornamental body 12.

A contoured post 14 is provided. The contoured post 14 extends between a first end 25 and a second end 26. The first end 25 of the post 14 interconnects with the ornamental body 12 at a hinge connection 28. The hinge connection 28 enables the contoured post 14 to pivot freely at the point of engagement with the ornamental body 12. In the shown embodiment, the first end 25 of the contoured post 14 is bent into an eye 30. The eye 30 is interlocked with the mounting loop 24 on the ornamental body 12 to create the hinge connection 28.

The contoured post 14 has a first section 32 that extends between the first end 25 and an acute angle bend 34. The contoured post 14 has a second section 36 that extends from the acute angle bend 34 to the second end 26. The second section 36 is curved for a reason that will later be explained.

A decorative stop 16 is provided. The decorative stop 16 is preferably an ornamental piece that selectively engages the contoured post 14 proximate its second end 26.

Figure 2:
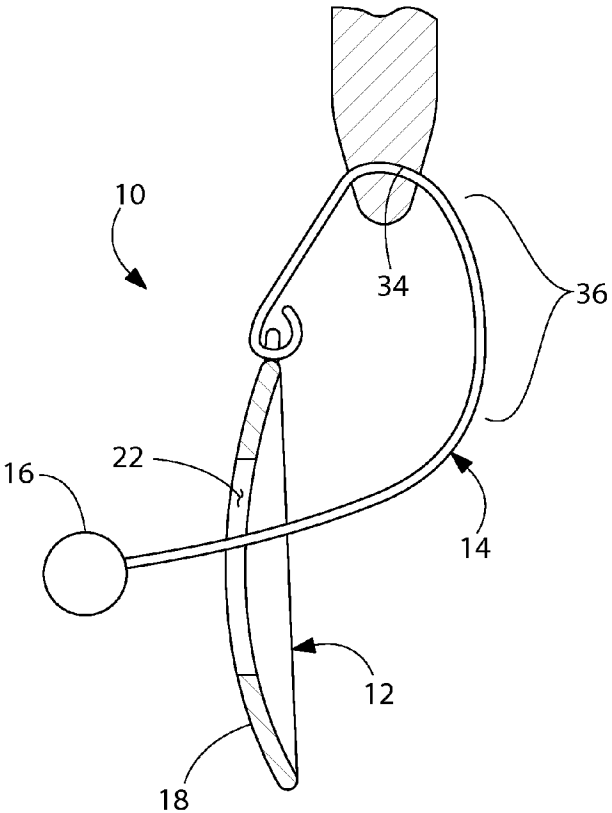
FIG. 2 is a side view of the embodiment of FIG. 1 hanging from an ear.

Referring to FIG. 1 in conjunction with FIG. 2, it will be understood that in order to wear the earring assembly 10, the decorative stop 16 is removed. The second end 26 of the contoured post 14 is inserted through a piercing in a person's earlobe until the piercing reaches the acute angle bend 34. The acute angle bend 34 prevents the contoured post 14 from accidentally falling out of the piercing. The decorative stop 16 is then connected to the second end 26 of the contoured post 14. The second section 36 of the contoured post 14 is shaped and sized so that the second section 36 extends through the inner opening 22 of the ornamental body 12. Accordingly, the second end 26 of the contoured post 14 terminates in front of the face surface 18 of the ornamental body 12. The decorative stop 16 is affixed to the contoured post 14 either at the second end 26 or proximate the second end 26. Accordingly, the decorative stop 16 is supported by the contoured post 14 in front of the face surface 18 of the ornamental body 12. As a result, the decorative stop 16 and a portion of the contoured post 14 are highly visible, being suspended in front of the face surface 18 of the ornamental body 12.

Since the contoured post 14 is connected to the ornamental body 12 at the hinge connection 28, it will be understood that the ornamental body 12 and the contoured post 14 can move independently of each other. Both the ornamental body 12 and the contoured post 14 may swing independently. This causes the second section 36 of the contoured post 14 and the decorative stop 16 to swing back and forth through the inner opening 22 of the ornamental body 12. The independent movement of the ornamental body 12 and the swinging contoured post 14 adds to the overall aesthetic appeal of the earring assembly 10.

Figure 3:
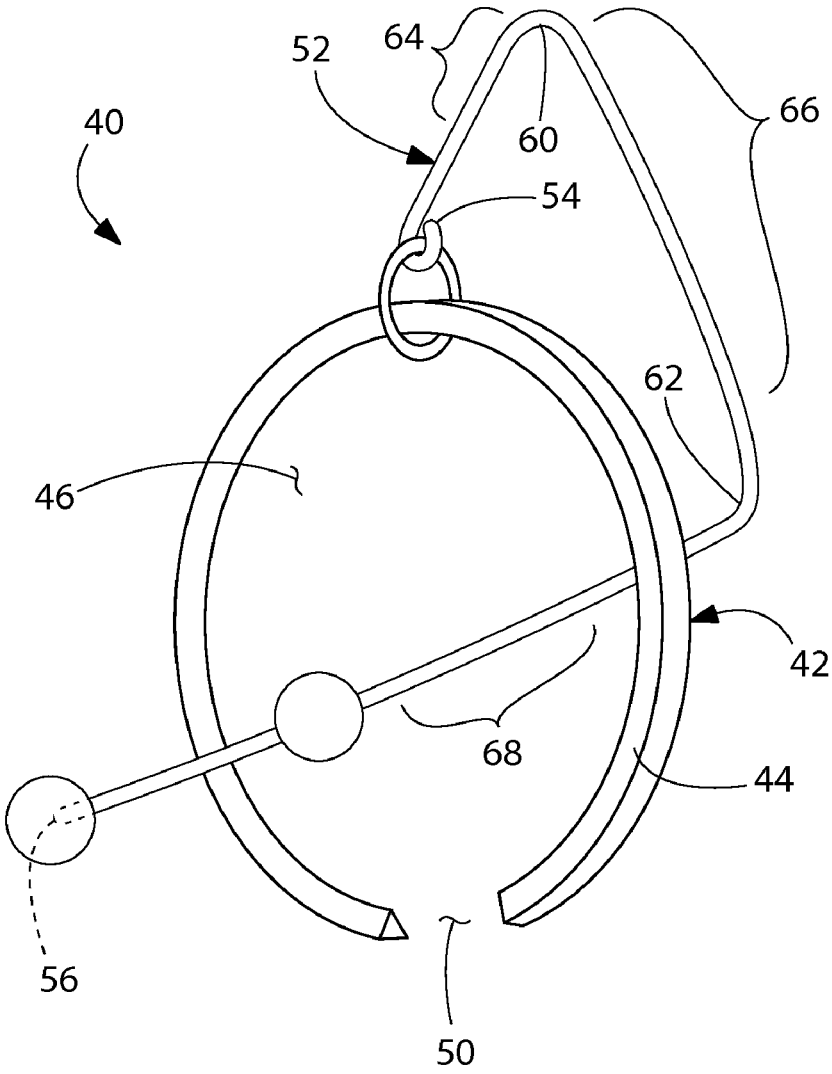
FIG. 3 is a perspective view of an alternate embodiment of an earring assembly.

Referring to FIG. 3, an alternate embodiment of an earring assembly 40 is shown. The earring assembly 40 has an ornamental body 42. Like the previous embodiment, the ornamental body 42 has a decorative face surface 44 that is designed to be viewed when the earring assembly 40 is viewed. Unlike the previous embodiments, the ornamental body 42 is not fully annular. The ornamental body 42 defines an inner opening 46. However, the inner opening 46 is not fully encircled by the ornamental body 42. Rather, a slot 50 is formed at the bottom of the ornamental body 42 that leads into the inner opening 46.

The contoured post 52 has a first end 54 and a second end 56. The first end 54 of the contoured post 52 connects to the ornamental body 42 with a hinge connection 58. The contoured post 52 also contains two bends. The two bends include an acute angle bend 60 and a right angle bend 62. The contoured post 52 has a first section 64 that extends from the first end 54 to the acute angle bend 60. A second section 66 extends from the acute angle bend 60 to the right angle bend 62. Lastly, a third section 68 extends from the right angle bend 62 to the second end 56.

In the embodiment of FIGS. 1 and 2, the contoured post 14 could not extend too far in front of the ornamental body 12 because the annular shape of the ornamental body 12 would prevent the second end 26 of the post 14 from retreating through the inner opening 22. In the embodiment of FIG. 3, the presence of the slot 50 enables the contoured post 52 to rotate out of the inner opening 46 without contacting the ornamental body 42. Accordingly, the length of the post need not be restrained. The second end 56 of the contoured post 52 can, therefore, extend significantly in front of the face surface 44 of the ornamental body 42.

It will be understood that the embodiments of the present invention that are illustrated and described are merely exemplary and that a person skilled in the art can make many variations to those embodiments. For instance, square, rectangular, triangular or any other looped structure can be used to create the ornamental body of the earring assembly. All such embodiments are intended to be included within the scope of the present invention as defined by the claims.

What is claimed is:

1. An earring assembly, comprising:

a stop;

an ornamental body having a face surface and a rear surface defined by a peripheral edge, wherein an inner opening is formed through said ornamental body between said face surface and said rear surface, and wherein said inner opening is large enough to enable said stop to pass therethrough;

a contoured post extending between a first end and a second end, wherein said first end of said contoured post is coupled to said ornamental body at a hinged connection that enables said ornamental body to swing from said hinged connection relative said contoured post when said earring assembly is worn, wherein said contoured post has a first section that extends away from said hinged connection behind said rear surface of said ornamental body and a second section that extends from said first section to said second end;

wherein said stop terminates said second end of said contoured post so that said second section extends through said inner opening and positions a rear surface of said stop in front of said hinged connection; and wherein said second end of said contoured post and said stop are free to move through said inner opening of said ornamental body when said earring assembly is worn and said contoured post moves relative said ornamental body.

2. The assembly according to claim 1, further including a mounting loop coupled to said ornamental body, wherein said mounting loop forms part of said hinged connection.

3. The assembly according to claim 2, wherein said first end of said contoured post is looped into an eye, wherein said eye is interconnected with said mounting loop to form said hinged connection.

4. The assembly according to claim 1, wherein said first section of said contoured post and said second section of said contoured post intersect at an acute angle bend.

5. The assembly according to claim 1, wherein said second section of said contoured post is curved.

6. The assembly according to claim 1, wherein said second section of said contoured post is at least twice as long as said first section.

7. The assembly according to claim 1, further including an open slot in said ornamental body extending between said peripheral edge and said inner opening.

8. The assembly according to claim 1, wherein said ornamental body is annular in shape.

9. An earring assembly, comprising:

a decorative stop;

an ornamental body having a face surface and a rear surface, wherein an inner opening is formed through said ornamental body between said face surface and said rear surface that is large enough for said decorative stop to pass therethrough;

a contoured post extending between a first end and a second end, wherein said first end of said contoured post is coupled to said ornamental body at a hinged connection that enables said ornamental body to swing from said hinged connection relative said contoured post when said earring assembly is worn, and wherein said contoured post is configured to extend through said inner opening in said ornamental body; and wherein said decorative stop is coupled to said contoured post proximate said second end, wherein said contoured post suspends a rear surface of said decorative stop in front of said hinged connection and enables said decorative stop to swing through said inner opening when said earring assembly is worn.

10. The assembly according to claim 9, further including a mounting loop coupled to said ornamental body, wherein said mounting loop forms part of said hinged connection.

11. The assembly according to claim 10, wherein said first end of said contoured post is looped into an eye, wherein said eye is interconnected with said mounting loop to form said hinged connection.

12. The assembly according to claim 9, wherein said contoured post has a first section and a second section that intersect at an acute angle bend.

13. The assembly according to claim 12, wherein said second section of said contoured post is curved.

14. The assembly according to claim 12, wherein said second section of said contoured post is at least twice as long as said first section.

15. The assembly according to claim 9, further including an open slot in said ornamental body extending between said inner opening and a peripheral edge of said ornamental body.

16. The assembly according to claim 9, wherein said ornamental body in annular in shape.

* * * * *